US005899389A

United States Patent [19]

Pataki et al.

[11] Patent Number: 5,899,389

[45] Date of Patent: May 4, 1999

[54] TWO STAGE FUEL INJECTOR NOZZLE ASSEMBLY

[75] Inventors: Árpád M. Pataki, Elizabethtown; Lester L. Peters, Columbus; Benjamin M. Yen, Columbus; Julius P. Perr, Columbus, all of Ind.

[73] Assignee: Cummins Engine Company, Inc., Columbus, Ind.

[21] Appl. No.: 08/867,356

[22] Filed: Jun. 2, 1997

[51] Int. Cl.[6] ..... F02M 47/02; F02M 61/20

[52] U.S. Cl. ..... 239/533.2; 239/88; 239/91; 239/533.3; 239/533.8; 239/533.9

[58] Field of Search ..... 239/88, 90, 91, 239/94, 96, 533.1, 533.2, 533.3, 533.4, 533.7, 533.8, 533.9

[56] References Cited

U.S. PATENT DOCUMENTS

| | | | |
|---|---|---|---|
| 2,075,949 | 4/1937 | Lemon | 239/533.8 X |
| 2,283,725 | 5/1942 | Eichelberg | 239/533.8 X |
| 3,339,848 | 9/1967 | Geiger | 239/533.4 X |
| 4,168,804 | 9/1979 | Hofmann | 239/533.11 |
| 4,200,237 | 4/1980 | Urlaub et al. | 239/533.12 |
| 4,202,500 | 5/1980 | Keiczek | 239/533.3 |
| 4,215,821 | 8/1980 | Eblen | 239/533.4 |
| 4,269,360 | 5/1981 | Kopse | 239/533.8 |
| 4,285,471 | 8/1981 | Eblen et al. | 239/533.4 |
| 4,382,554 | 5/1983 | Hofmann | 239/533.9 |
| 4,546,739 | 10/1985 | Nakajima et al. | 123/299 |
| 4,758,169 | 7/1988 | Steiger | 239/96 |
| 4,984,738 | 1/1991 | Winquist | 239/88 |
| 5,199,398 | 4/1993 | Nylund | 123/299 |
| 5,458,292 | 10/1995 | Haperman | 239/533.4 |
| 5,647,536 | 7/1997 | Yen et al. | 239/90 |
| 5,765,755 | 6/1998 | Peters et al. | 239/90 X |

FOREIGN PATENT DOCUMENTS

| | | | |
|---|---|---|---|
| 4-140468 | 5/1992 | Japan | 239/533.4 |
| 546598 | 7/1942 | United Kingdom | 239/533.8 |
| 2266559 | 11/1993 | United Kingdom . | |

*Primary Examiner*—Andres Kashnikow
*Assistant Examiner*—Robin O. Evans
*Attorney, Agent, or Firm*—Sixbey, Friedman, Leedom & Ferguson; Charles M. Leedom, Jr.; Tim L. Brackett, Jr.

[57] ABSTRACT

A fuel injector assembly is provided which operates to effectively creating a low injection flow rate followed by a high injection flow rate during all engine operating conditions, including idle and low engine speed conditions, to produce a high quality fuel spray with proper atomization and thus improved fuel air mixing resulting in improved emissions abatement and fuel economy. The assembly includes two biased valve elements designed to sequentially open and close to initially open a limited number of orifices followed by the opening of a remainder of the orifices thereby effectively varying the available cross sectional flow area from the nozzle cavity into the combustion chamber of the engine during the injection event. The nozzle valve elements may be spring biased or fluid pressure biased and include biasing surfaces sized to cause the sequential opening and closing of the elements.

12 Claims, 3 Drawing Sheets

TWO STAGE FUEL INJECTOR NOZZLE ASSEMBLY

TECHNICAL FIELD

This invention relates to an improved nozzle assembly for fuel injectors which effectively controls the flow rate of fuel injected into the combustion chamber of an engine at high injection pressures.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. When the pressure of the fuel within the nozzle cavity exceeds the biasing force of the nozzle spring, the nozzle valve element moves outwardly to allow fuel to pass through the nozzle orifices, thus marking the beginning of injection.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed nozzle fuel injector systems. One method of controlling the initial rate of fuel injection is to spill a portion of the fuel to be injected during the injection event. For example, U.S. Pat. No. 5,647,536, entitled *Injection Rate Shaping Nozzle Assembly for a Fuel Injector* and commonly assigned to the assignee of the present application discloses a closed nozzle injector which includes a spill circuit formed in the nozzle valve element for spilling injection fuel during the initial portion of an injection event to decrease the quantity of fuel injected during this initial period thus controlling the rate of fuel injection. A subsequent unrestricted injection flow rate is achieved when the nozzle valve moves into a position blocking the spill flow causing a dramatic increase in the fuel pressure in the nozzle cavity. Other rate shaping systems decrease rate of fuel flow during the initial portion of the injection event by, for example, throttling the fuel to the nozzle orifices. Although these systems create injection rate shaping, the spilling and throttling of fuel during the initial period of injection achieves a reduced injection flow rate by reducing the injection pressure adjacent the nozzle orifices. The decrease in injection pressure may disadvantageously result in decreased atomization of the fuel spray by the nozzle orifices, thus adversely affecting fuel economy and increasing emissions.

U.S. Pat. No. 5,199,398 to Nylund discloses a fuel injection valve arrangement for injecting two different types of fuels into an engine which includes inner and outer poppet type nozzle valves. During each injection event, the inner nozzle valve opens a first set of orifices to provide a preinjection and the outer nozzle valve opens a second set of orifices to provide a subsequent main injection. The outer poppet valve is a cylindrical sleeve positioned around a stationary valve housing containing the inner poppet valve.

U.S. Pat. No. 4,546,739 to Nakajima et al. discloses a fuel injector with inner and outer injector nozzle valves biased to close respective sets of spray holes and operable to open at different fuel pressures. The inner nozzle valve is reciprocally mounted in a central bore formed in the outer nozzle valve. However, the nozzle valves are controlled such that both are open simultaneously at high engine speeds while only one is opened at low speeds, and therefore, these valves are not both opened during a single injection event to achieve two stage injection.

U.K. Patent Application No. 2266559 to Hlousek discloses a closed nozzle injector assembly including a hollow nozzle valve for cooperating with one valve seat formed on an injector body to provide a main injection through all the injector orifices and an inner valve nozzle reciprocally mounted in the hollow nozzle for creating a pre-injection through a few of the injector orifices. However, the inner valve element opens and closes to provide a separate pre-injection event and therefore does not function to shape the primary injection. Moreover, the valve seat allowing the inner valve nozzle to block the pre-injection flow is formed on the hollow valve member and the inner valve nozzle is biased outwardly away from the injector orifices. This arrangement requires a third valve seat for cooperation with the inner valve element when its in a pre-injection open position to prevent flow through all of the injector orifices, resulting in an unnecessarily complex and expensive assembly. Also, this assembly is designed for use with two different sources of fuel requiring additional delivery passages in the injector.

Consequently, there is a need for a fuel injector incorporating a simple, cost effective nozzle assembly capable of effectively and reliably creating a low injection flow rate during an initial stage of an injection event to thereby control emissions.

SUMMARY OF THE INVENTION

It is an object of the present invention, therefore, to overcome the disadvantages of the prior art and to provide a nozzle assembly for a fuel injector which is capable of effectively and predictably controlling the rate of fuel injection to improve emissions and fuel economy.

It is another object of the present invention to provide a closed nozzle injector capable of effectively creating a low rate of fuel injection during the initial stage of an injection event while also achieving a high fuel spray quality from the injector orifices.

Another object of the present invention to provide a closed nozzle injector capable of creating an initial low injection flow rate followed by a high injection flow rate even during low engine speed conditions so as to maintain optimal atomization of the fuel by the nozzle orifices.

It is yet another object of the present invention to provide a nozzle assembly capable of shaping the rate of fuel injection which is also simple and inexpensive to manufacture.

It is still another object of the present invention to provide a rate shaping nozzle assembly for an injector which effectively slows down the rate of fuel injection during the initial stage of an injection event while subsequently increasing the rate of injection to rapidly achieve a high injection pressure.

It is a further object of the present invention to provide an injector for use in a variety of fuel systems, including common rail system, accumulator pump systems and pump-line-nozzle fuel systems, which effectively controls the rate of injection at each cylinder location.

It is a still further object of the present invention to provide an injector nozzle assembly which can be easily adapted for use in a unit injector.

Still another object of the present invention is to provide a closed nozzle injector capable of varying the number of spray orifices being used during an injection event.

Yet another object of the present invention is to provide a simple closed nozzle injector capable of varying the effective cross sectional flow area through the orifices so as to create optimum injection rate shaping at all engine conditions.

These and other objects of the present invention are achieved by providing a closed nozzle injector assembly for injecting fuel at high pressure into the combustion chamber of an engine, comprising an injector body containing an injector cavity and a plurality of injector orifices communicating with one end of the injector cavity to discharge fuel into the combustion chamber, wherein the plurality of injector orifices includes a first set of orifices and a second set of orifices and the injector body includes a fuel transfer circuit for transferring supply fuel to the plurality of injector orifices. A nozzle valve device is positioned in one end of the injector cavity adjacent the plurality of injector orifices for controlling fuel flow through the plurality of orifices. The needle valve device includes a first nozzle valve element and a first valve seat formed on the injector body. The first nozzle valve element is movable in a first direction from a closed position against the first valve seat, blocking flow through the first set of injector orifices, to an open position permitting flow through the first set of injector orifices. The first nozzle valve element includes a cavity opening into at least one end of the element. The nozzle valve device also includes a second nozzle valve element and a second valve seat formed on the injector body. The second nozzle valve element is movable in the same first direction as the first nozzle valve element, from a closed position against the second valve seat, blocking flow through the second set of injector orifices, to an open position permitting flow through the second set of injector orifices. The second nozzle valve element is telescopingly received within the cavity of the first nozzle valve element to form a sliding fit with an inner surface of the first nozzle valve element. Also, a valve opening device is provided for moving the first and second nozzle valve elements into their respective open positions. The valve opening device includes respective pressure surfaces formed on the first and second nozzle valve elements, wherein fuel pressure acting on the pressure surfaces opens the first and second nozzle valve elements. The pressure surfaces are sized to cause movement of one of the first and second nozzle valve elements into the open position during an initial low injection rate stage of the injection event while the other nozzle valve element is maintained in the closed position. The pressure surfaces are also sized to cause movement of the other of the first and second nozzle valve elements into an open position during a subsequent high injection rate stage of the injection event following the low injection rate stage.

The injector cavity includes a nozzle cavity surrounding a lower portion of the first nozzle valve element. The fuel transfer circuit may include an annular recess formed between the first nozzle valve element and the second nozzle valve element and a transfer passage formed in the first nozzle valve element for directing fuel from the nozzle cavity to the annular recess for delivery to the first set of injector orifices. Fuel in the nozzle cavity increases from a low pressure level to a high pressure level during an injection event so as to cooperate with the pressure surface areas of the nozzle valve elements to cause the opening of one of the elements, and then subsequently, as the pressure increases to cause the opening of the other nozzle valve element while the former nozzle valve element is maintained in the open position.

The assembly may include a biasing device for biasing the first and second nozzle valve elements toward the closed positions. The biasing device may include biasing surfaces formed on the first and second nozzle valve elements, a control volume positioned adjacent the biasing surfaces and a pressurized supply of biasing fluid supplied to the control volume for applying biasing pressure forces to the biasing surfaces. Alternatively, the biasing device may be a first biasing spring for biasing the first nozzle valve element and a second biasing spring for biasing the second nozzle valve element toward the closed position.

The first and second biasing springs may be positioned in overlapping relationship along a longitudinal axis, that is, along their axial extent. The upper ends of the first and second biasing springs may be mounted in a fixed position relative to the injector body. The biasing springs, or the pressurized supply of biasing fluid, functions to maintain the first and second nozzle valve elements, in positive sealing abutment against their respective valve seats. A fuel sack may be formed in the lower end of the injector body in communication with the nozzle cavity when the second needle valve element is in the open position. A spill circuit formed in the second nozzle valve element directs fuel from the fuel sack to the injector cavity to relieve fuel pressure in the sack when the second nozzle valve element is in the closed position. The spill circuit may include an axial passage and a transverse passage formed in the second nozzle valve element.

DETAILED DESCRIPTION OF THE PREFERRED EMBODIMENT

Throughout this application, the words "inwardly" and "outwardly" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

Figure 1:
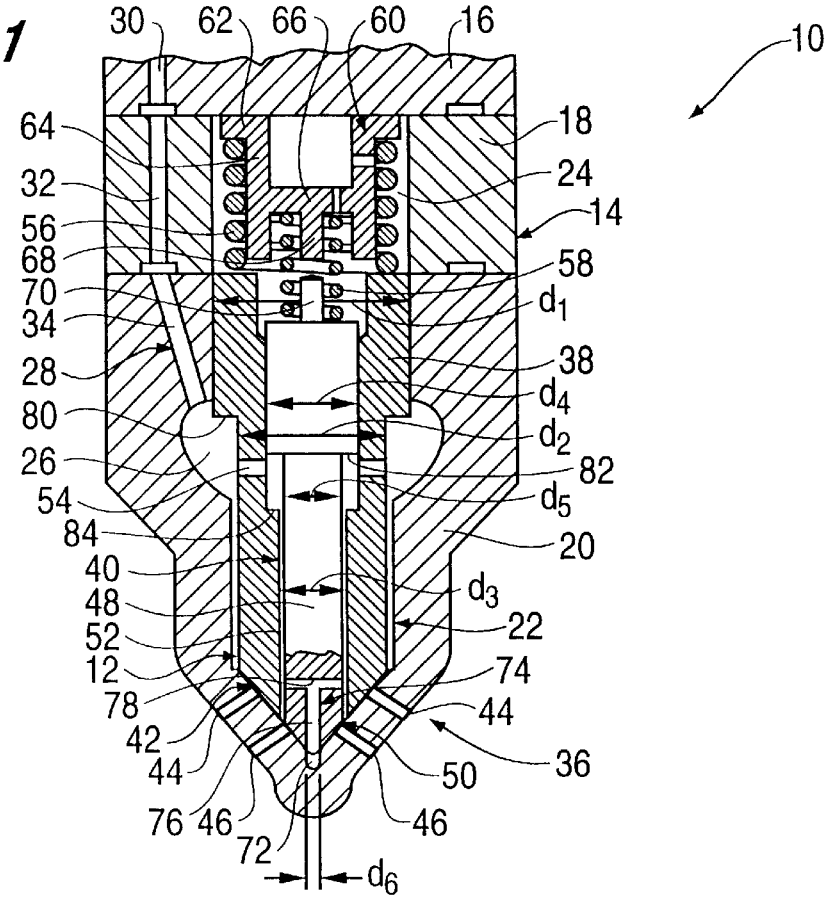
FIG. 1 is an enlarged, partial cross sectional view of a preferred embodiment of the closed nozzle injector assembly of the present invention.

Referring to FIG. 1, there is shown the closed nozzle injector assembly of the present invention, indicated generally at 10, incorporating a nozzle valve device 12 capable of effectively creating a two stage injection event thereby improving fuel economy and decreasing emissions. Closed nozzle assembly 10 generally includes an injector body 14 formed from a spacer 16, a spring housing 18, a nozzle housing 20 and a retainer (not shown). The spring housing 18 and nozzle housing 20 are held in compressive abutting relationship in the interior of the retainer between spacer 16 and an upper end of the retainer in a conventional manner, such as disclosed in U.S. Pat. No. 4,531,672, the entire contents of which is hereby incorporated by reference. For example, the upper end of the retainer may contain internal threads for engaging corresponding external threads on spacer 16 or an additional body component positioned outward from spacer 16, to permit the entire injector body 14 to be held together by simple relative rotation of the retainer with respect to the upper threaded component.

Injector body 14 includes an injector cavity, indicated generally at 22, which includes a spring cavity 24 formed in spring housing 18 and a nozzle cavity 26 formed in nozzle housing 20. Injector body 14 further includes a fuel transfer circuit 28 comprised of delivery passages 30, 32 and 34 formed in spacer 16, spring housing 18 and nozzle housing 20, respectively, for delivering fuel from a high pressure source to nozzle cavity 26. Injector body 14 also includes a plurality of injector orifices 36 positioned to fluidically connect nozzle cavity 26 with a combustion chamber of an engine (not shown).

The closed nozzle injector assembly 10 of the present invention can be adapted for use with a variety of injectors and fuel systems. For example, closed nozzle injector assembly 10 may receive high pressure fuel from a separate high pressure source, such as a high pressure common rail or alternatively a dedicated pump assembly, such as in a pump-line-nozzle system. Closed nozzle injector assembly 10 may be incorporated into a unit injector having a mechanically actuated plunger mounted in the injector body, such as disclosed in U.S. Pat. No. 4,531,672. As discussed more fully hereinbelow, the present assembly may also be used in combination with other rate shaping features of a fuel system and/or injector to optimally shape the rate of fuel injection during an injection event. Thus, closed nozzle injector assembly 10 of the present invention may be incorporated into any injector or fuel system which supplies high pressure fuel to nozzle cavity 26 via fuel transfer circuit 28.

Nozzle valve device 12 includes an outer nozzle valve element 38 having a generally cylindrical shape forming a cavity 40 and an outer valve seat 42 for abutment by the lower end of outer nozzle valve element 38. Injector orifices 36 include an outer set of orifices 44 and an inner set of injector orifices 46. Outer valve seat 42 is formed adjacent first set of injector orifices 44 so as to prevent fuel flow from nozzle cavity 26 through first set of injector orifices 44 when outer nozzle valve element 38 is in the closed position as shown in FIG. 1. Nozzle valve device 12 also includes an inner nozzle valve element 48 reciprocally mounted in cavity 40 of outer nozzle valve element 38, and an inner valve seat 50 formed on the inner surface of nozzle housing 20 adjacent the inner set of injector orifices 46. When inner nozzle valve element 48 is in the closed position as shown in FIG. 1, the lower end of nozzle valve element 48 abuts inner valve seat 50 so as to prevent fuel flow from nozzle cavity 26 into the inner set of injector orifices 46. The upper end of inner nozzle valve element 48 is sized to form a close sliding fit with the inner surface of outer nozzle valve element 38 so as to create a fluid seal.

Fuel transfer circuit 28 further includes an annular recess 52 formed between outer nozzle valve element 38 and inner nozzle valve element 48, and a transverse passage 54 extending through outer nozzle valve element 38 to fluidically connect nozzle cavity 26 with annular recess 52. Transverse passage 54 and annular recess 52 create a fluid flow path from nozzle cavity 22 to an area immediately adjacent inner valve seat 50. Thus, positioning of outer nozzle valve element 38 and inner nozzle valve 48 in the closed position, as shown in FIG. 1, blocks fuel flow through the inner and outer sets of injector orifices 44, 46 while movement outwardly toward an open position permits flow through the set of orifices associated with the moving nozzle valve element.

Closed nozzle injector assembly 10 also includes an outer bias spring 56 and an inner bias spring 58, i.e. coil springs, positioned within spring cavity 24 for biasing outer nozzle valve element 38 and inner nozzle valve element 48, respectively, into the closed position as shown in FIG. 1. A spring guide 60 is positioned in spring cavity 24 in abutment with the inner surface of spacer 16 to provide a seating surface for both springs 56, 58 while laterally guiding or supporting the springs. Spring guide 60 includes an annular spring seat 62 for supporting outer bias spring 56 and a cylindrical extension 64. A transverse wall 66 extends across cylindrical extension 64 to form a seating surface for inner bias spring 58. Spring guide 60 may also include a stop extension 68 extending from transverse wall 66 inwardly for cooperating with a stop 70 formed on the upper end of inner nozzle valve element 48 to limit the outward movement of element 48 and thereby define an outermost open position. Lower end of cylindrical extension 64 functions as a stop for limiting the outward movement of outer nozzle valve element 38. The spring arrangement shown in the embodiment of FIG. 1 essentially positions the springs in parallel relationship, while the upper ends of springs 56, 58 are fixed relative to injector body 14. Thus, the movement of one nozzle valve element and biasing spring will not effect the position of, and forces on, the other nozzle valve element.

Injector body 14 may also include a fuel sack 72 formed in the lower end of nozzle housing 20 adjacent the inner set of injector orifices 46. Closed nozzle assembly 10 is also provided with a spill circuit 74 for draining high pressure fuel from fuel sack 72 to improve the sealing of inner nozzle valve element 48 against inner valve seat 50 thereby preventing bouncing of element 48 on its seat. Spill circuit 74 also ensures that high pressure fuel from fuel sack 72 does not leak through the inner set of injector orifices 46 into the combustion chamber causing emissions. Spill circuit 74 includes an axial passage 76 extending axially from the lower end of inner nozzle valve element 48 outwardly and a transverse passage 78 extending transversely through inner nozzle valve element 48 to fluidically connect axial passage 76 with annular recess 52. Thus, when inner nozzle valve element 48 is in the closed position as shown in FIG. 1, any high pressure fuel in fuel sack 72 will be directed through axial passage 76 and transverse passage 78 into annular recess 52 thereby relieving the pressure in fuel sack 72 and preventing valve bounce and fuel leakage into the combustion chamber.

Closed nozzle injector assembly 10 functions to create a two stage injection with a first stage producing a very limited injection flow rate so as to reduce the quantity of fuel injected during the initial stage of the injection event to a desired low level. The present assembly advantageously controls the rate of fuel injection during an initial stage of the injection event by using two nozzle valve elements 38, 48 to independently control fuel flow through a respective set of injector orifices 44, 46 and by forming the injector orifices 44, 46 with predetermined cross sectional flow areas necessary to achieve the desired flow rate at the expected operating pressures of each stage. Moreover, the sequential movement of outer and inner nozzle valve elements 38, 48 from the closed position to the open position to achieve the two stage injection is achieved by providing nozzle valve elements 38, 48 with respective pressure surfaces exposed to the high pressure fuel which are sized relative to one another to permit one nozzle valve element to move into an open position while the other element remains in the closed position and then, as the fuel pressure continues to increase, to permit the other nozzle valve element to open the remaining injector orifices resulting in a full injection. Of course, the pressure surfaces on outer nozzle valve element 38 and inner nozzle valve element 48 must be of a sufficient area to create forces necessary to overcome the bias force of the respective springs 56, 58. As shown in FIG. 1, outer nozzle valve element 38 includes a pressure surface 80 formed by an annular land upon which fuel pressure generates forces tending to move outer nozzle valve element 38 into its open position. Outer nozzle valve element 38 also includes an annular pressure surface 84 positioned in recess 52 upon which fuel pressure generates forces tending to move outer nozzle valve element 38 toward its closed position. Inner nozzle valve element 48 includes a pressure surface 82 formed by an annular land on which fuel pressure generates forces tending to move valve element 48 towards its open position. In addition, axial passage 76 of spill circuit 74 creates a pressure surface, corresponding to diameter $d_6$, which is the smallest sealing diameter of inner valve element 48, upon which fuel pressure acts to force inner nozzle valve element 48 toward its open position. The sequential opening of the nozzle valve elements 38, 48 is achieved by forming the pressure surfaces of the appropriate size relative to one another, and relate to the spring forces of biasing springs 56, 58, so as to cause one element to move into the open position at a lower pressure level and the other element to subsequently move into an open position at a higher pressure level thus achieving a low injection flow rate through one set of injector orifices and then a subsequent high injection flow rate through the full set of injector orifices. Specifically, outer nozzle valve element 38 and inner nozzle valve element 48 can be designed with relative dimensions, i.e. diameters, as shown in FIG. 1, so as to preset the fuel pressure at which the particular element will open, i.e. opening pressure $P_o$. Thus the pressure surface areas are selected by selecting the diameters to cause the particular valve element to open at a desired pressure during the injection event. As a result, the pressure surface areas can be selected to achieve the desired opening sequence for nozzle valve elements 38, 48 by selecting the diameter shown in FIG. 1. Mathematically, the opening pressure for inner nozzle valve element 48 ($P_{oi}$) can be calculated by the following equation.

$$P_{oi} = \frac{4(S_2)}{(d_4^2 - d_5^2 + d_6^2)\pi}$$

Likewise, the opening pressure for outer nozzle valve element 38 ($P_{oo}$) can be calculated using the following equation.

$$P_{oo} = \frac{4(S_1)}{(d_1^2 - d_2^2 + d_3^2 - d_4^2)\pi}$$

The closing pressure for outer nozzle valve element 38 ($P_{co}$) and inner nozzle valve element 48 ($P_{ci}$) can be calculated using the following equations.

$$P_{co} = \frac{4(S_1)}{(d_1^2 - d_4^2)\pi}$$

$$P_{ci} = \frac{4(S_2)}{d_4^2\pi}$$

As can be seen, the various dimensions or diameters of the different components can be selected so that one nozzle valve element opens at a lower pressure while the second nozzle valve element opens at a higher pressure.

In effect, closed nozzle injector assembly 10 minimizes the quantity of fuel injected during an initial stage of injection by effectively varying the available cross sectional flow area from nozzle cavity 26 into the combustion chamber of the engine during the injection event. This variation is achieved by providing a dual nozzle valve element assembly for effectively opening only a portion of the injector orifices at a lower injection pressure and then opening the remainder of the orifices at a higher nozzle cavity pressure.

Figure 2:
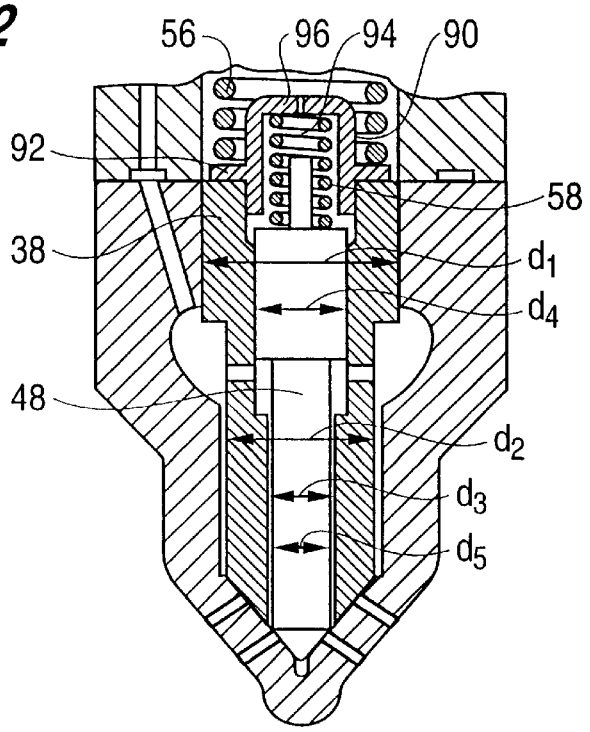
FIGS. 2 is an enlarged, partial cross sectional view of a second embodiment of the closed nozzle injector assembly of the present invention.

Referring now to FIG. 2, a second embodiment of the present closed nozzle injector assembly is illustrated which is similar to the embodiment of FIG. 1 except that a different spring arrangement is utilized and the spill circuit 74 of FIG. 1 has been omitted. Of course, the spill circuit 74 shown in the embodiment of FIG. 1 may be incorporated into the embodiment of FIG. 2. This second embodiment includes a spring guide 90 which includes an annular spring seat 92 positioned in abutment between the lower end of bias spring 56 and the upper end of outer nozzle valve element 38. Thus, spring guide 90 moves with outer nozzle valve element 38 as it moves between its open and closed positions. Spring guide 90 includes an inner cavity 94 for receiving inner bias spring 58. A transverse wall 96, formed at the upper end of spring guide 90, forms a seat for inner spring 58. Thus, outer and inner bias springs 56, 58 are mounted in series. As a result, if the inner nozzle valve element 48 is designed to open first during an injection event, the diameter $d_5$ corresponds to a pressure surface area exposed to high pressure fuel while inner nozzle valve element 48 is in the open position, upon which pressure forces act tending to move both inner nozzle valve element 48 and outer nozzle valve element 38 outwardly due to the serial arrangement of biasing springs 56, 58 and the floating nature of spring guide 90. Thus, assuming the inner nozzle valve element 48 opens first during the injection event, the opening pressure for nozzle valve element 48 ($P_{oi}$) can be calculated as follows:

$$P_{oi} = \frac{4(S_2)}{(d_4^2 - d_5^2)\pi}$$

while the opening pressure for outer nozzle valve element 38 ($P_{oo}$) can be calculated using the following equation:

$$P_{oo} = \frac{4(S_1)}{(d_1^2 - d_2^2 + d_3^2)\pi}$$

In addition, assuming the outer nozzle valve element 38 closes first during the injection event, the closing pressure ($P_{co}$) can be calculated as follows:

$$P_{co} = \frac{4(S_1)}{d_1^2\pi}$$

while the closing pressure for inner nozzle valve element 48 ($P_{ci}$) can be calculated as follows:

$$P_{ci} = \frac{4(S_2)}{d_4^2\pi}$$

Therefore, the second embodiment of FIG. 2 can also be used to effectively control the rate of fuel injection by minimizing the quantity of fuel injected during an initial stage of injection.

Figure 3A:
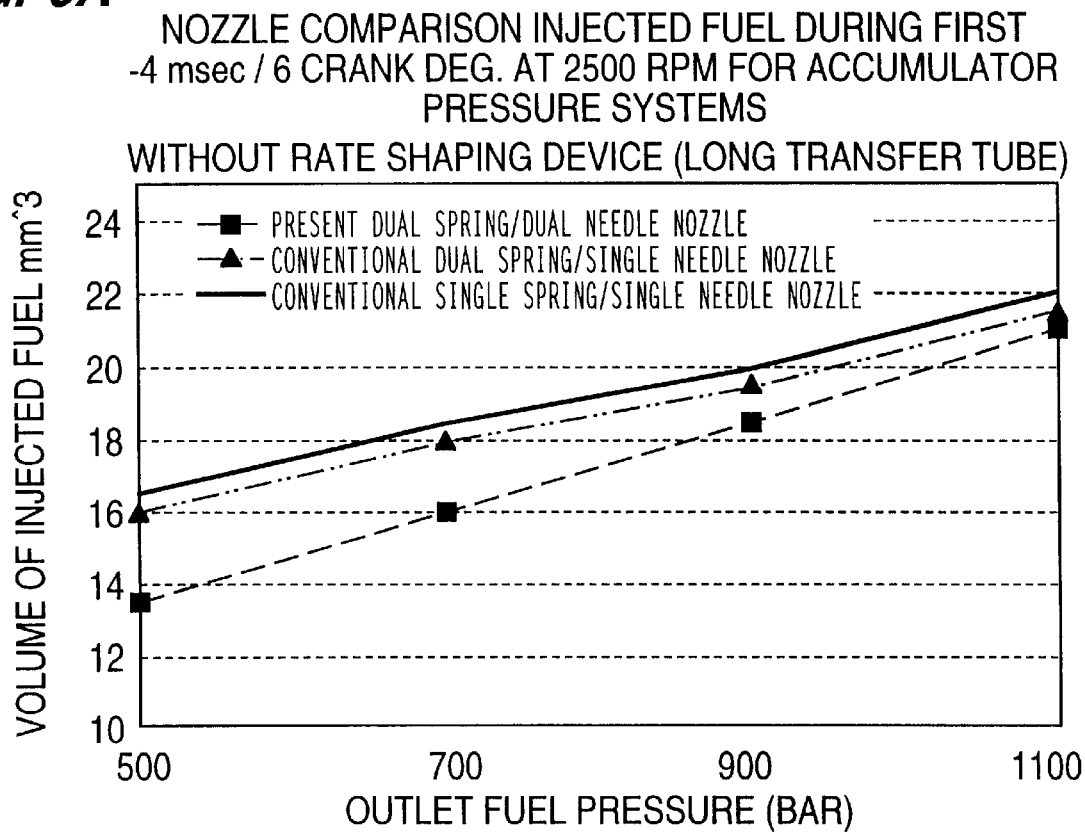
FIG. 3A is graph comparing the volume of fuel injected by the dual spring/dual needle nozzle of FIG. 1 with other conventional nozzle assemblies.
Figure 3B:
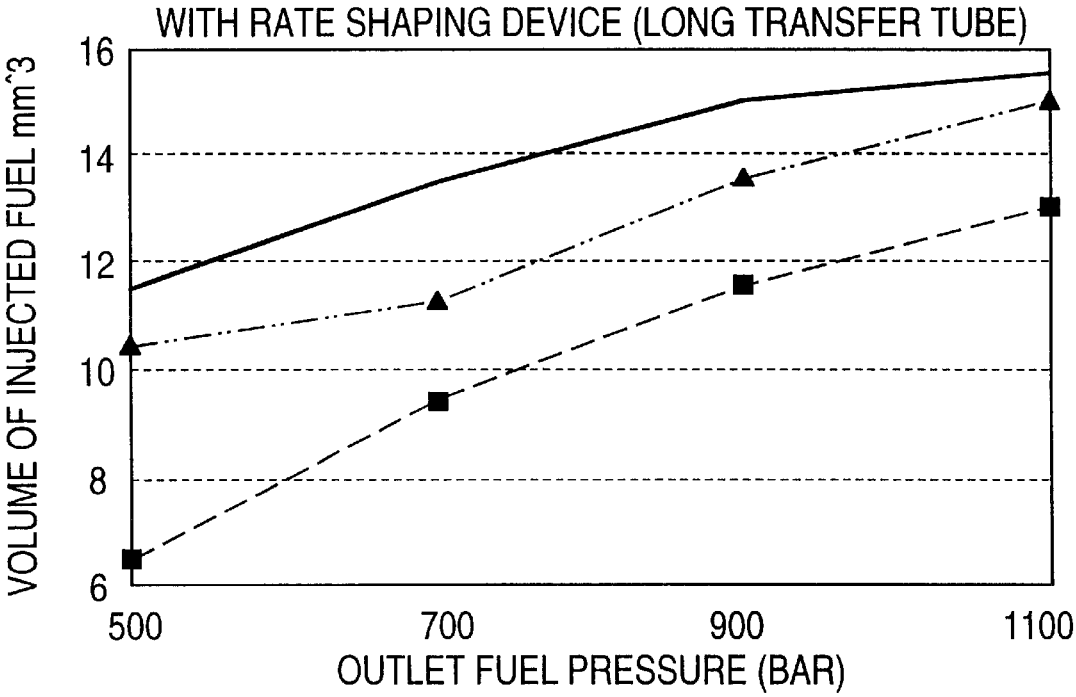
FIG. 3B is graph similar to FIG. 3A comparing the volume of fuel injected by the dual spring/dual needle nozzle of the present invention when used in combination with another rate shaping device, which is situated between an accumulator and the injector, with conventional nozzle assemblies used in combination with the same rate shaping device.

Referring now to FIGS. 3A and 3B, the closed nozzle injector assembly 10 of the present invention is compared to a conventional single spring/single needle nozzle and a conventional dual spring/single needle nozzle assembly. As can be seen, the present closed nozzle injector assembly which incorporates a dual spring/dual needle nozzle arrangement advantageously reduces the quantity of fuel injected during the first 0.4 milliseconds of the injection event. This reduction in the volume of injected fuel plays an important role in minimizing emissions while improving fuel economy. Moreover, by combining the present closed nozzle injector assembly 10 with another rate shaping device, the volume of fuel injected can be reduced significantly as shown in FIG. 3B. The data of FIG. 3B resulted from the combination of the different nozzle assemblies applied to an accumulator pump type system utilizing a transfer tube of a predetermined length positioned between an accumulator and an injection control valve upstream from a rotary distributor for achieving injection rate shaping. This "long transfer tube" type of rate shaping is disclosed in PCT Patent Publication WO 94/27041, entitled *Compact High Performance Fuel System With Accumulator,* which is hereby incorporated by reference. The present closed nozzle assembly 10 is especially effective at achieving an optimum injection rate shape, alone, or in combination with another rate shaping device associated with the fuel system, when small fuel quantities are injected. Thus, during the initial opening of the first nozzle valve element, outer or inner, a minimum amount of fuel can be admitted into the combustion chamber in a controlled manner. As can be seen in FIG. 3B, the difference in the quantity of fuel injected at lower injection pressures by the present closed nozzle assembly, relative to the other conventional assemblies, is greater than the difference in the quantity of fuel injected at the higher injection pressures, even during the first 0.4 milliseconds of the injection event. The ability to limit the quantity of fuel injected during the very beginning of the injection event, i.e. initial opening of one of the nozzle valve elements, is especially advantageous at low engine speeds and idle conditions wherein a small quantity of fuel is injected during the entire injection event. Conventional fuel injectors and injector systems utilizing a rate shaping device, such as the long transfer tube, cannot effectively create a two stage injection at low injection pressures such as experienced at idle conditions, since the initial opening of the conventional needle nozzle opens the entire set of injector orifices causing the entire fuel quantity to be injected at a low pressure before the fuel pressure in the nozzle cavity increases to a high level and before the rate shaping device can have any positive effect since so little fuel is actually being injected during idle conditions. Using a conventional dual spring/single needle nozzle, the fuel will be allowed to reach a high pressure. However, the high pressure will be created in front of the needle seat, not in front of the injector orifices, thereby resulting in poor fuel penetration into the cylinder and possibly undesirably large fuel droplets. The present closed nozzle injector assembly 10, however, restricts the flow area by restricting the number of injector orifices open during the initial portion of the injection event thus restricting the flow of even the smallest quantity of fuel typically injected during idle conditions.

Figure 4A:
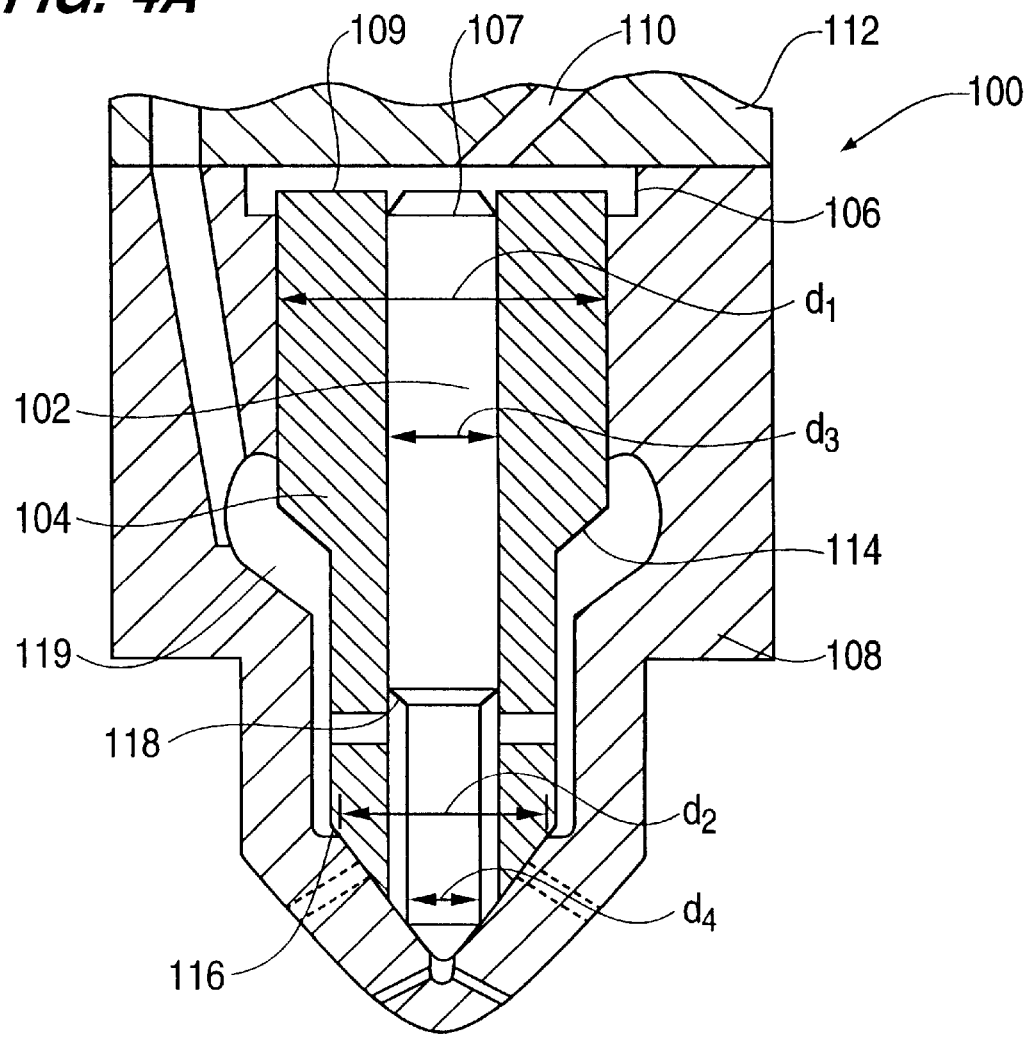
FIG. 4A is an enlarged, partial cross sectional view of another embodiment of the closed nozzle injector assembly of the present invention.
Figure 4B:
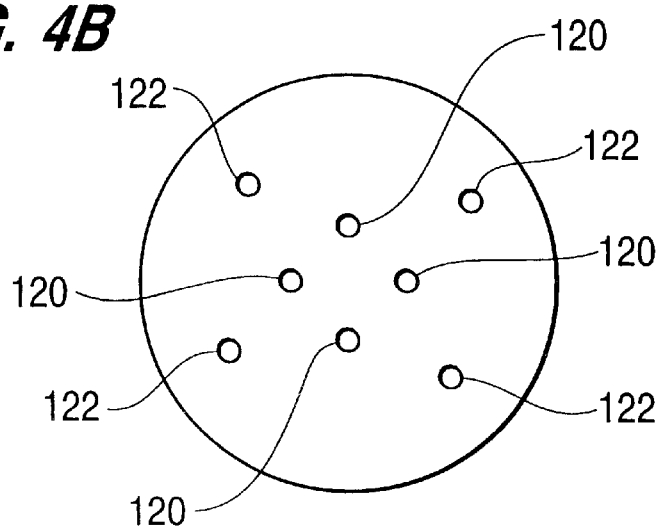
FIG. 4B is a bottom view of the lower portion of the nozzle assembly of FIG. 4A showing the injector orifice arrangement.

Now referring to FIGS. 4A and 4B, a closed nozzle injector assembly 100 of a third embodiment of the present invention is illustrated which includes an inner nozzle valve element 102 positioned within a cavity formed in an outer nozzle valve element 104. This embodiment differs from the embodiments of FIGS. 1 and 2 primarily in that a biasing fluid is used to bias valve elements 102 and 104 into the closed position as shown in FIG. 4A. Instead of the spring arrangement of the previous embodiments, a recess 106 is formed in nozzle housing 108 adjacent the upper end of valve elements 102, 104, to form a control volume for receiving biasing fluid. A biasing fluid supply passage 110 is formed in a spacer 112 for supplying pressurized biasing fluid to the control volume. The upper ends of nozzle valve elements 102, 104 include biasing or pressure surfaces 107, 109 respectively, upon which the fluid pressure generates forces tending to bias the valve elements 102, 104 into the closed position. The pressure forces acting on pressure surfaces 107, 109 act to oppose the fuel pressure forces acting on pressure surfaces 118 and 114, 116 of valve elements 102, 104, respectively. Thus, by controlling the size of the various pressure surfaces and biasing surfaces formed on nozzle valve elements 102 and 104, the opening pressures for each of the valve elements 102, 104 can be selected. Specifically, the opening pressure for the inner nozzle valve element 102 ($P_{oi}$) can be calculated as follows:

$$P_{oi} = \frac{P_c d_3^2}{d_3^2 - d_4^2}$$

while the opening pressure for outer nozzle valve element 104 ($P_{oo}$) may be calculated using the following equation:

$$P_{oo} = \frac{P_c(d_1^2 - d_3^2)}{d_1^2 - d_2^2}$$

where $P_c$ is the pressure of the biasing fluid in the control volume.

Clearly, as with the previous embodiment, the pressure surface areas can be selected by selecting the appropriate diameters so that one nozzle valve element opens at a lower pressure while a second nozzle valve element opens at a higher pressure. Moreover, this embodiment also permits the opening pressures for the inner and outer nozzle valve elements to be varied subsequent to manufacturing, and perhaps during operation depending on the operating conditions of the engine by varying the pressure of the biasing fluid supplied to the control volume. Thus, the present embodiment allows an additional degree of control over the opening pressures which may be advantageous in certain applications. For example, as shown in Table I, the control pressure has a significant impact on the opening pressure of the nozzle valve elements and thus can be used to selectively vary the opening pressures as desired so as to control the injection rate shape and quantity.

TABLE I

| DIAMETER (mm) | | | | CONTROL PRESSURE | OPENING PRESSURE (PSI) | |
|---|---|---|---|---|---|---|
| | | | | | INNER | OUTER NOZZLE |
| $d_1$ | $d_2$ | $d_3$ | $d_4$ | (PSI) | NOZZLE VALVE | VALVE |
| 8 | 7 | 4 | 2.5 | 2500 | 4103 | 10667 |
| 8 | 7 | 4 | 2.5 | 3000 | 4923 | 12800 |
| 8 | 7 | 4 | 2.5 | 3500 | 5744 | 14933 |
| 8.5 | 6 | 4 | 3.6 | 2100 | 11053 | 4186 |
| 8.5 | 6 | 4 | 3.6 | 2500 | 13158 | 4983 |
| 8.5 | 6 | 4 | 3.6 | 2900 | 15263 | 5780 |

FIG. 4B is included to show one possible injector orifice arrangement which may be used with any of the embodiments described hereinabove. The four inner injector orifices 120 are sealed from the nozzle cavity 119 (FIG. 4A) when inner nozzle valve element 102 is in the closed position. Outer injector orifices 122 are sealed by outer nozzle valve element 104 when in the closed position as shown in FIG. 4A. The inner injector orifices 120 and outer injector orifices 122 may each include four apertures equally spaced in a circular manner to achieve optimum fuel distribution in the combustion chamber. Of course, each group of inner and outer injector orifices may be comprised of any number of apertures arranged in a variety of patterns so long as the pattern permits nozzle valve elements 102, 104 to effectively seal the respective injector orifices from the nozzle cavity when in the closed position.

The present invention results in several important advantages over conventional nozzle assemblies. First, the various embodiments of the present closed nozzle injector assembly are capable of effectively creating a two stage injection event during which the quantity of fuel injected during the initial portion of the first stage of the injection event is reduced in comparison to conventional nozzle assemblies. By injecting low fuel quantities during the initial stage of injection, the present closed nozzle injector assembly optimally minimizes emissions while improving fuel economy. These advantages are especially realized at low engine speeds and idle conditions during which only a very small amount of fuel is to be injected. The entire amount of this small fuel quantity is injected early in the period of increasing pressure in the nozzle cavity and thus the fuel is injected at a lower pressure. As a result, the fuel injected by conventional nozzle assemblies does not flow through the injector orifices at a high enough pressure to achieve optimum fuel atomization thereby adversely affecting air fuel mixing and possibly increasing emissions and decreasing fuel economy. In other words, the large flow area through all the injector orifices of a conventional nozzle assembly is excessive at idle conditions due to the small quantity of fuel injected causing the fuel to flow through the injector orifices at such a low flow rate so as to prevent the proper atomization of the fuel. Although some conventional nozzle assemblies reduce the pressure in an effort to reduce the flow rate and achieve rate shaping, injection pressure reduction adversely affects fuel atomization by the spray orifices. The present closed nozzle injector assembly, however, limits the flow area through the injector orifices by first opening a limited number of orifices, thus decreasing the quantity of fuel injected during the initial portion, thereby allowing the initially opened orifices to properly produce a high quality fuel spray with proper atomization and thus improved fuel air mixing resulting in decreased emissions and improved fuel economy.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed nozzle injector assembly for injecting fuel at high pressure into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a nozzle valve means positioned in one end of said injector cavity adjacent said plurality of injector orifices for controlling fuel flow through said plurality of injector orifices, said nozzle valve means including a first nozzle valve element and a first valve seat formed on said injector body, said first nozzle valve element movable in a first direction from a closed position against said first valve seat blocking flow through said first set of injector orifices to an open position permitting flow through said first set of injector orifices, said first nozzle valve element containing a cavity opening into at least one end of said first nozzle valve element, said nozzle valve means further including a second nozzle valve element and a second valve seat formed on said injector body, said second valve element movable in said first direction from a closed position against said second valve seat blocking flow through said second set of injector orifices to an open position permitting flow through said second set of injector orifices, said second nozzle valve element telescopingly received within said cavity of said first nozzle valve element to form a sliding fit with an inner surface of said first nozzle valve element; and valve opening means for moving said first and said second nozzle valve elements into said respective open positions, said valve opening means including respective pressure surfaces formed on said first and said second nozzle valve elements, wherein fuel pressure acting on said pressure surfaces opens said first and said second valve elements, said pressure surfaces being sized to cause movement of one said first and said second nozzle valve elements into said open position during an initial low injection rate stage of said injection event while the other of said first and said second nozzle valve elements is maintained in said closed position, and to cause movement of the other of said first and said second nozzle valve elements into said open position during a subsequent high injection rate stage of said injection event following said low injection rate stage; and biasing means for biasing said first and said second nozzle valve elements toward said closed position, said biasing means including biasing surfaces formed on said first and said second nozzle valve elements, a control volume positioned adjacent said biasing surfaces and a pressurized supply of biasing fluid supplied to said control volume for applying biasing pressure forces to said biasing surfaces which is independent from, and opposes the fuel pressure acting on said pressure surfaces used to open said first and said second nozzle valve elements.

2. The closed nozzle injector assembly of claim 1, further including a biasing means for biasing said first and said second nozzle valves inwardly toward said plurality of injector orifices into positive sealing abutment with said first and second valve seats.

3. The closed nozzle injector assembly of claim 1, further including a fuel sac formed in a lower end of said injector body in communication with said nozzle cavity when said second nozzle valve element is in said open position, and a spill circuit formed in said second nozzle valve element for directing fuel from said sac to said injector cavity to relieve fuel pressure in the sac when said second nozzle valve element is in said closed position.

4. The closed nozzle injector assembly of claim 3, wherein said spill circuit includes an axial passage and a transverse passage formed in said second nozzle valve element.

5. The closed nozzle injector assembly of claim 1, wherein said injector cavity includes a nozzle cavity surrounding a lower portion of said first nozzle valve element, said fuel transfer circuit including an annular recess formed between said first nozzle valve element and said second nozzle valve element, said fuel transfer circuit further including a transverse passage formed in said first nozzle valve element for directing fuel from said nozzle cavity to said annular recess for delivery to said first set of injector orifices.

6. A closed nozzle injector assembly for injecting fuel at high pressure into the combustion chamber of an engine, comprising:

an injector body containing an injector cavity forming a nozzle cavity at one end of said injector body and a plurality of injector orifices communicating with said nozzle cavity to discharge fuel into the combustion chamber, said plurality of injector orifices including a first set of orifices and a second set of orifices, said injector body including a fuel transfer circuit for transferring supply fuel to said nozzle cavity, said infector body containing a spring cavity;

a first and a second biasing springs positioned in said spring cavity for biasing said first and said second nozzle valve elements toward the closed positions, respectively;

a spring guide and seat member removably positioned in said spring cavity and formed separately from the said injector body, said spring guide and seat member including a first integral abutment surface for alignment with said first biasing spring, and a second integral abutment surface for alignment with said second biasing spring;

a nozzle valve means positioned in said nozzle cavity adjacent said plurality of injector orifices for controlling fuel flow through said plurality of injector orifices, said nozzle valve means including a first nozzle valve element and a first valve seat formed on said injector body, said first nozzle valve element movable from a closed position against said first valve seat blocking flow through said first set of injector orifices to an open position permitting flow through said first set of injector orifices, said first nozzle valve element containing a cavity opening into a lower end of said first nozzle valve element, said nozzle cavity surrounding a lower portion of said first nozzle valve element, said nozzle valve means further including a second nozzle valve element and a second valve seat formed on said injector body, said second nozzle valve element movable from a closed position against said second valve seat blocking flow through said second set of injector orifices to an open position permitting flow through said second set of injector orifices, said second nozzle valve element positioned within said cavity of said first nozzle valve element, said fuel transfer circuit including an annular recess formed between said first nozzle valve element and said second nozzle valve element, said fuel transfer circuit further including a transverse passage formed in said first nozzle valve element for directing fuel from said nozzle cavity to said annular recess for delivery to said first set of injector orifices; and valve opening means for moving said first and said second nozzle valve elements into said respective open positions, said valve opening means including a first pressure surface area formed on said first nozzle valve element and positioned in said nozzle cavity and a second pressure surface area formed on said second nozzle valve element and positioned in said annular recess, wherein fuel in said nozzle cavity increases from a low pressure level to a high pressure level during an injection event, said first and said second pressure surface areas being sized to open one of said first and said second nozzle valve elements during the injection event in response to the low pressure level and maintain the one nozzle valve element in the open position throughout the injection event and to open the other of said first and said second nozzle valve elements during the injection event in response to the high pressure level.

7. The closed nozzle injector assembly of claim 6, further including a biasing means for biasing said first and said second nozzle valve elements toward said closed position, said biasing means including a first biasing spring for biasing said first nozzle valve element and a second biasing spring for biasing said second nozzle valve element.

8. The closed nozzle injector assembly of claim 7, wherein said first and said second biasing springs are positioned in overlapping relationship along a longitudinal axis.

9. The closed nozzle injector assembly of claim 8, wherein each of said first and said second biasing springs includes an upper end, said upper ends each mounted in a fixed position relative to said injector body.

10. The closed nozzle injector assembly of claim 6, further including a biasing means for biasing said first and said second nozzle valves inwardly toward said plurality of injector orifices into positive sealing abutment with said first and said second valve seats.

11. The closed nozzle injector assembly of claim 5, further including a fuel sac formed in a lower end of said injector body in communication with said nozzle cavity when said second nozzle valve element is in said open position, and a spill circuit formed in said second nozzle valve element for directing fuel from said sac to said injector cavity to relieve fuel pressure in the sac when said second nozzle valve element is in said closed position.

12. The closed nozzle injector assembly of claim 11, wherein said spill circuit includes an axial passage and a transverse passage formed in said second nozzle valve element.

* * * * *